United States Patent [19]

Seeley et al.

[11] 4,254,196

[45] Mar. 3, 1981

[54] METHOD OF PREPARING LITHOPLATES AND PLATE

[75] Inventors: Douglas A. Seeley, High Bridge; Victor M. Kamhi, Middlesex, both of N.J.

[73] Assignee: American Hoechst Corporation, Somerville, N.J.

[21] Appl. No.: 86,081

[22] Filed: Oct. 18, 1979

[51] Int. Cl.[3] ..... G03G 13/26; G03G 13/32

[52] U.S. Cl. ..... 430/17; 430/49; 101/454; 101/458; 101/459

[58] Field of Search ..... 430/49, 17, 18, 56; 101/453, 454, 457, 458, 459, 460, 462, 463

[56] References Cited

U.S. PATENT DOCUMENTS

| | | | |
|---|---|---|---|
| 2,939,787 | 6/1960 | Giaimo | 430/56 X |
| 3,236,640 | 2/1966 | Tomanek et al. | 430/49 |
| 3,615,385 | 10/1971 | Lind | 430/49 |
| 3,653,886 | 4/1972 | Lind et al. | 430/49 |
| 3,944,417 | 3/1976 | Lind | 430/49 |
| 4,066,453 | 1/1978 | Lind et al. | 430/49 |

*Primary Examiner*—Roland E. Martin, Jr.
*Attorney, Agent, or Firm*—L. S. Burnett

[57] ABSTRACT

A process for preparing a lithoplate by electrophotographic means is provided wherein the toned image is fused, the photoconductive layer in the nonimage area is decoated, and finally, the fused toner is selectively removed leaving oleophilic photoconductive material as the image portion.

8 Claims, 4 Drawing Figures

METHOD OF PREPARING LITHOPLATES AND PLATE

DESCRIPTION

BACKGROUND OF THE INVENTION

This invention relates to an improved electrophotographic reproduction process using a photoconductive insulating layer on a conductive support to make a lithographic printing plate. Particularly, it relates to a process for removal of unwanted fused toner as a last step prior to printing and to the product thereby produced.

In the practice of lithography using bimetallic plates, such as copper laminated to aluminum, it is necessary to use a photoresist layer to prepare the image. The photoresist is coated over the surface of the copper, imaged under a mask and developed. After development, the residual photoresist is present in imagewise configuration leaving a pattern of exposed copper corresponding to the nonimage. At this point, the plate is etched with, for example, ferric chloride solution to dissolve the unprotected copper. After rinsing, the residual photoresist is stripped with a suitable solvent, leaving an oleophilic copper image on a hydrophilic aluminum support. The copper may also be treated with dilute acids to enhance its oleophilicity.

Lithographic offset plates have been prepared by electrophotographic methods. Such plates are normally composed of a photoconductive material such as zinc oxide, cadmium sulfide or certain organic compounds dispersed in an ink-repelling binder and coated on a suitable base material such as paper, metal or a film. These plates are imaged by the normal electrophotographic process involving forming an electrostatic charge on the surface of the plate, exposing the charged plate on an electrically conductive support to an image pattern of electromagnetic radiation to leak away the charge on the areas struck by light, developing the resulting electrostatic image pattern by contact with an electroscopic liquid or solid developer, and fixing the developed image by drying or heating. The resultant imaged plate may be then used as a master for offset lithographic printing.

Following the aforementioned fixing step, the fused or fixed toner lies in imagewise configuration upon a thin adherent, continuous layer of photoconductive material which in turn lies upon the conductive support. In those cases where the non-toned photoconductor surface is not hydrophilic, the toner covered image may be treated with a decoating solution, which removes photoconductive coating without removing that part of the coating masked by fixed toner to reveal the nonimage areas. At this point, the plate is put on the press whereupon the oleophilic toner over the image areas attracts ink and transmit ink to the blanket in offset printing (or directly in direct lithography) while the decoated support areas attract water and repel ink as in normal lithography.

Plates may be charged, exposed, developed and decoated in automatic machinery using incoherent light as in U.S. Pat. No. 3,999,511 or in fully automatic laser exposing machinery as described in U.S. Pat. No. 4,149,798.

It has been found that sporadically, and without explanation, the printed image may become mottled in large black areas at the outset of a printing run until about three thousand impressions have been made. This phenomenon may be present with either dry toned or liquid toned plates, but persists somewhat longer, when it occurs, with liquid toned plates. In any case, the mottled prints are unsightly and must be discarded, causing an economic loss.

On some occasions yellow or other light colored inks may slowly dissolve toner from the image on the plate during printing with consequent degradation of purity of color on the printed sheet.

In critical printing applications, dot gain is to be avoided. It is believed in some quarters that the toned image contributes undesirably to dot gain in these cases.

Accordingly, it is an object of this invention to provide a product and a process which eliminates the problem of mottled prints on the press.

It is another object to provide purer colors in color printing. Still another object is to minimize dot gain in critical printing.

BRIEF SUMMARY OF THE INVENTION

This and other objects of the invention are achieved by removing the fixed toner either manually or in automatic processing equipment by employing, after the decoating step, a step of selective removal of toner.

A number of specific solvents are capable of removing toner without attacking or dissolving the photoconductive material underlying the toner. They include certain aromatic, aliphatic, naphthenic hydrocarbons and their mixtures.

BRIEF DESCRIPTION OF THE DRAWINGS

The sequence of figures illustrates the steps of toning (developing) (FIG. 1), fusing (fixing) (FIG. 2), decoating (FIG. 3) and toner removal (FIG. 4).

DETAILED DESCRIPTION

Figure 1:
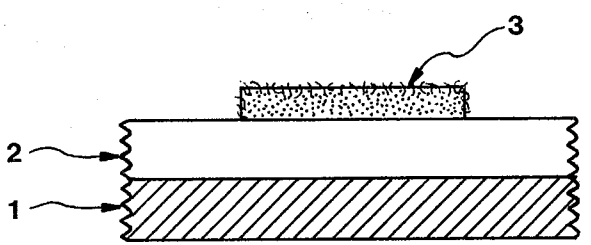
FIG. 1 illustrates the photoconductive insulating layer on a conductive support with an image portion or dot composed of toner just after development lying upon the photoconductive layer.

The suitable solvents for removal of fused toner from the image are certain aromatic, aliphatic and naphthenic hydrocarbons. The principle requirements for suitable solvents are high solvency for fused toner and little or no attack on photoconductors. These two requirements can be called solubility differentiation. Additionally, there should be no evidence of attraction of ink to the nonimage, failure of the image to attract ink and transfer it to either blanket or paper or image loss when printing. It is further desirable that solvents have as high flash points as possible to minimize flammability.

Suitable solvents are m,p-diethylbenzene, methylcyclohexane, mesitylene, chlorinated hydrocarbons, tetralin, methyl decanoate, decalin and commercial mixtures of hydrocarbons approximately (by weight) 29%–95% aromatic, 0%–28% naphthenic, 5%–43% paraffins, and mixtures of these. Of these, the aforementioned m,p diethylbenzene, mesitylene, tetrachloroethylene, methylcyclohexane and the mixtures of aromatic, naphthenic and paraffinic hydrocarbons are preferred.

Toners may be either liquid or dry as are well known in the practice of electrophotography. Dry toners are finely powdered pigmented thermoplastics which are charged oppositely to the charge of the image. They are thus attracted to it during development. Liquid toners are pigment particles suspended in an insulating liquid. When the charged image is sprayed with or briefly immersed in liquid toner, the charged particles deposit on it. The surplus liquid is removed. This is the development step. These standard processes are described in Jacobson and Jacobson, "Imaging Systems," John Wiley & Sons, New York, 1976, p. 269.

After the development step, the now visible image is fixed or fused. Heat or solvent vapors may be used for this purpose.

Following fixation, the plate is decoated to remove the nonimage photoconductor which is normally as oleophilic as the image. This permits the support which is hydrophilic to operate in concert with the oleophilic image to produce lithographic printing. Typical solutions known as decoaters are described in British Pat. No. 944,126. These are strongly alkaline solutions containing alkaline phosphates and silicates augmented by organic solvents such as alcohols, glycols or glycol ethers.

Preferred photoconductors, which the decoater removes and which should not be attacked or dissolved by the solvents for fused toner, include organics such as the various oxazole compounds disclosed in U.S. Pat. No. 3,257,203, including 4,5 diphenyloxazoles, triphenylamine derivatives, higher condensed aromatic compounds such as anthracene, benzocondensed heterocyclic compounds, pyrazoline and imidazole derivatives, triazole and oxadiazole derivatives disclosed in U.S. Pat. No. 3,189,447, especially 2,5-bis(p-aminophenyl)-1,3,4 oxadiazoles, and vinyl aromatic polymers such as polyvinyl anthracene, polyacenaphthylene, poly-N-vinylcarbazole, as well as copolymers thereof. The photoconductive insulating layer may also contain a resinous binder if desired, and a sensitizer which selectively sensitizes the photoconductive material to light, for example 400 to 500 nm. Where the nonimage areas of the photoconductive insulating layer are to be removed for offsetting printing, the photoconductive compound and binder, if present, should be suitable for solubility differentiation with respect to the toner covered image areas such that the nonimage areas of the photoconductive insulating layer may be removed by decoater solutions without affecting the toned image areas. Especially suitable printing plates for processing in accordance with the present invention are marketed under the trademark ELFASOL® by the Kalle Division of Hoechst, AG, of Wiesbaden, West Germany, and by the Azoplate Division of American Hoechst Corporation, of Murray Hill, New Jersey.

The support sheet should be relatively conductive. Metal, such as aluminum, zinc, magnesium or copper plates, and plates of cellulosic origin such as specially treated papers, cellulose hydrate, cellulose acetate or cellulose butyrate films may be used. Some plastic materials, for example polyamides in film form or metal vaporized films, may also be used as supports.

The steps of charging, exposing to incoherent light or laser light, developing, fixing and decoating may be manually accomplished in separate operations or in tandem in automatic equipment.

Figure 2:
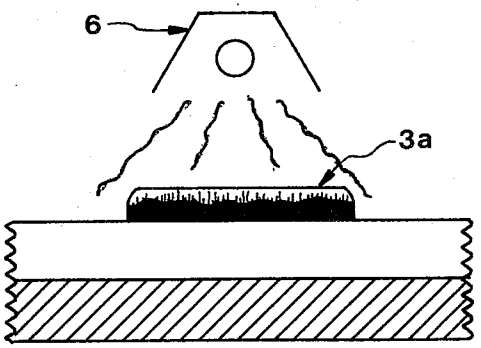
FIG. 2 illustrates the toner dot after fusing.
Figure 3:
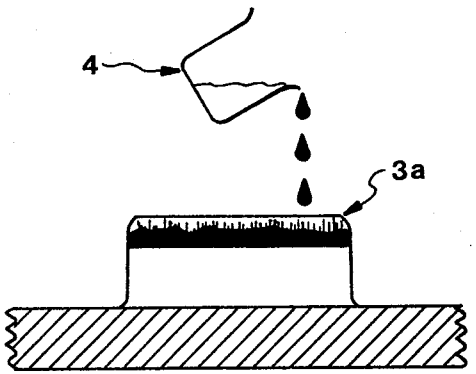
FIG. 3 shows the decoating or removal of photoconductive material where it has not been protected by the fused image.
Figure 4:
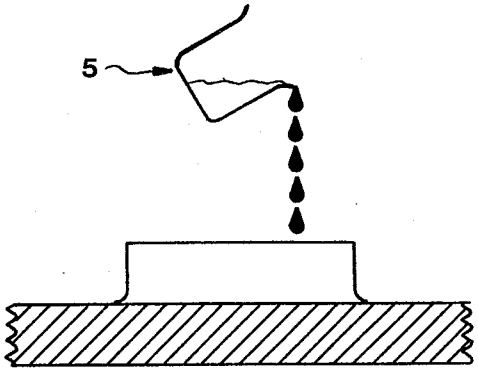
FIG. 4 shows an image dot composed of photoconductive material left on the support after the removal of toner.

Turning now to the drawings, FIG. 1 shows a section of an electrophotographic plate just after development. The conductive support is 1. Directly adherent thereupon is the insulating photoconductor 2, while 3 represents a portion of the image composed of unfused toner. FIG. 2 shows the toner image, 3*a*, now fused due to heat from a source 6. As an alternative to heat, solvent vapor may be employed. FIG. 3 shows the decoating step in which decoating solution 4 in a vessel falls upon the plate. It removes the photoconductor 2 in all areas unprotected by the fused toner 3*a*. FIG. 3 shows the resultant decoated plate, in which fused toner lies upon photoconductor with both in imagewise configuration. In previous practice, at this point, the plate is placed upon the press. Finally, in FIG. 4 is shown the result after solvent, 5, has removed fused toner from the photoconductor. This yields a press-ready electrophotographic printing plate comprising the support with a toner-free thin layer comprising a photoconductive insulating material adherent thereupon in imagewise configuration. This layer consists of only the photographic insulating material. In accordance with the invention, it is at this point that the plate is now placed on the press. A plate which has its toner removed in this manner does not sporadically cause mottling in large solid areas.

Solvents were screened for effectiveness in removing toner by placing plate samples which were charged, toned and fixed, on the Gardner Straight Line Washability and Abrasion Machine. Thirty ml of the solvent being tested was poured on a fresh applicator pad. The machine was turned on and the plate was scrubbed with the wet pad until all the toner was removed. The number of scrubbing strokes necessary was recorded.

To test the solvent attack on the plates, untoned plates were baked in a forced air oven at 180° C. for 40 seconds. Using the abovementioned apparatus and technique these samples were scrubbed with 30 ml. of each solvent for ten times the number of strokes found necessary to remove the toner with that particular solvent. The amount of coating removed was determined from weight loss.

The following examples illustrate the operation of the invention:

EXAMPLE 1

An automatic processor was filled with 12 liters of decoating solution in its first (decoating) station. The decoating solution contained ethoxyethoxyethanol, n-propanol, sodium metasilicate and tripotassium phosphate. In the second (rinsing) station there was 5 liters of a hydrocarbon solvent with a composition of 29% aromatics (all above $C_8$ level), 28% naphthenics and 43% paraffinics. The boiling range of the solvent was 300°–400° F. In the third station there was 5 liters of a dilute solution containing phosphoric acid.

An electrophotographic plate with an insulating photoconductor layer according to the teachings of U.S. Pat. No. 3,189,447 was used. After toning, fusing took place at 150° C.

The machine's operating parameters were:

| | |
|---|---|
| Decoating Temperature: | 30° C. |
| Transport Speed: | 1.7 in/sec. |

Thirty plates were processed as described above. Every tenth plate was inked with a standard rub-up ink. The toner was found to be almost completely removed with no evidence of scumming, blinding or image loss.

EXAMPLES 2-8

Using the Gardner Straight Line Washability and Abrasion Machine, the preferred solvents were tested to determine the number of strokes required to remove toner and the percent of photoconductor remaining after using ten times the number of strokes with each of the solvents.

| Solvent | Toner Removal No. of Strokes Required | Elfasol Coating (% Remaining) |
|---|---|---|
| M,p - Diethylbenzene | 3 | 42% |
| Mesitylene | 3 | 59% |
| Tetrachloroethylene | 3 | 44% |
| Methylcyclohexane | 3 | 91% |
| Amsco Super Hi-Flash | 3 | 50% |
| Shell Super VM&P | 3 | 95% |
| Amsco 46 Spirits | 5 | 91% |

The composition of the above trade named solvents as inferred from manufacturers data is as follows:

| | % aromatic | % naphthenic | % aliphatic |
|---|---|---|---|
| Amsco Super Hi-Flash | 95 | 0 | 5 |
| Shell Super VM&P | 66 | 57 | 28 |
| Amsco 46 Spirits | 29 | 28 | 43 |

What is claimed is:

1. A press-ready electrophotographic lithographic printing plate comprising a support with a toner-free thin layer comprising a monomeric organic photoconductive insulating material adherent thereupon in imagewise configuration.

2. A press-ready electrophotographic printing plate according to claim 1 in which said image contains a 4,5 diphenyloxazole.

3. A press-ready electrophotographic lithographic printing plate according to claim 1 in which said support is selected from the group consisting of aluminum, zinc, magnesium, copper, specially treated papers, cellulose hydrate, fibers of cellulose acetate, cellulose butyrate, polyamides and metal vaporized films.

4. A press-ready electrophotographic lithographic printing plate according to claim 2 in which said support is aluminum.

5. A process for preparing a printing plate which comprises providing a thin coherent organic photoconductive insulating coating adherent on a conductive base material, and a. electostatically charging said photoconductive insulating layer, b. imagewise exposing said charged insulating layer to leak away the charge on the areas struck by light, c. developing the remaining charged areas with electroscopic material, d. fixing the image of electroscopic material thus obtained, e. removing said photoconductive coating in the non-image areas only by contact with a first selective solvent which does not dissolve or attack the fixed electroscopic material, f. removing the electroscopic material present in imagewise configuration by contact with a second selective solvent incapable of dissolving or attacking said insulating material so that said insulating material is left in imagewise configuration.

6. A process acc. claim 5 in which said photoconductive insulating layer contains a 4,5 diphenyloxazole.

7. A process according to claim 6 in which said second selective solvent is selected from the group consisting of m,p-diethylbenzene, mesitylene, chlorinated hydrocarbons, methylcyclohexane and commercial mixtures of hydrocarbons approximately, by weight 29%-95% aromatic, 0%-28% naphthenic, 5%-43% paraffinic and mixtures of these.

8. A process according to claim 6 in which said second selective solvent is approximately by weight 29% aromatic, 28% naphthenic, and 43% aliphatic.

* * * * *